US007135228B2

(12) United States Patent
Sen et al.

(10) Patent No.: US 7,135,228 B2
(45) Date of Patent: Nov. 14, 2006

(54) ELASTIC, HEAT AND MOISTURE RESISTANT BICOMPONENT AND BICONSTITUENT FIBERS

(75) Inventors: Ashish Sen, Midland, MI (US); John Klier, Midland, MI (US); Rajen M. Patel, Lake Jackson, TX (US); Hongyu Chen, Midland, MI (US); Thoi H. Ho, Lake Jackson, TX (US)

(73) Assignee: Dow Global Technologies Inc., Midland, MI (US)

( * ) Notice: Subject to any disclaimer, the term of this patent is extended or adjusted under 35 U.S.C. 154(b) by 445 days.

(21) Appl. No.: 10/195,232

(22) Filed: Jul. 15, 2002

(65) Prior Publication Data

US 2003/0055162 A1 Mar. 20, 2003

Related U.S. Application Data

(60) Provisional application No. 60/306,018, filed on Jul. 17, 2001.

(51) Int. Cl.
*D01F 6/04* (2006.01)
*D01F 6/46* (2006.01)

(52) U.S. Cl. ..... 428/373; 428/394; 428/395; 428/392

(58) Field of Classification Search ..... 428/364, 428/373, 392, 394, 395
See application file for complete search history.

(56) References Cited

U.S. PATENT DOCUMENTS

| | | | | |
|---|---|---|---|---|
| 4,425,393 | A | 1/1984 | Benedyk et al. | 428/95 |
| 4,663,221 | A * | 5/1987 | Makimura et al. | 442/200 |
| 4,950,541 | A * | 8/1990 | Tabor et al. | 428/373 |
| 4,957,790 | A | 9/1990 | Warren | 428/34.9 |
| 5,082,899 | A * | 1/1992 | Sawyer et al. | 525/74 |
| 5,108,827 | A * | 4/1992 | Gessner | 428/219 |
| 5,133,917 | A * | 7/1992 | Jezic et al. | 264/210.8 |
| 5,185,199 | A | 2/1993 | Sawyer | 428/288 |
| 5,272,236 | A | 12/1993 | Lai et al. | 526/348.5 |
| 5,278,272 | A | 1/1994 | Lai et al. | 526/348.5 |
| 5,324,576 | A | 6/1994 | Reed et al. | 428/224 |
| 5,380,810 | A | 1/1995 | Lai et al. | 526/352 |
| 5,472,775 | A | 12/1995 | Obijeski et al. | 428/220 |
| 5,858,885 | A | 1/1999 | Hamilton et al. | 442/184 |
| 5,922,417 | A * | 7/1999 | Singleton et al. | 427/558 |
| 6,140,442 | A | 10/2000 | Knight et al. | 526/348.1 |
| 6,225,243 | B1 * | 5/2001 | Austin | 442/361 |
| 6,436,534 | B1 * | 8/2002 | Knight et al. | 428/365 |
| 6,500,540 | B1 * | 12/2002 | Langohr et al. | 428/364 |
| 6,773,810 | B1 * | 8/2004 | Sen et al. | 428/370 |

FOREIGN PATENT DOCUMENTS

| | | |
|---|---|---|
| EP | 0859073 A1 | 8/1998 |
| JP | 60045611 | 3/1985 |
| JP | 61194221 | 8/1986 |
| JP | 4316609 | 11/1992 |
| WO | 99/60060 | 11/1999 |
| WO | 01/36535 A1 | 5/2001 |

* cited by examiner

*Primary Examiner*—David W. Wu
*Assistant Examiner*—Rip A Lee

(57) ABSTRACT

Fibers having improved resistance to moisture at elevated temperatures comprise at least two elastic polymers, one polymer heat-settable and the other polymer heat-resistant, the heat-resistant polymer comprising at least a portion of the exterior surface of the fiber. The fibers typically have a bicomponent and/or a biconstituent core/sheath morphology. Typically, the core comprises an elastic thermoplastic urethane, and the sheath comprises a homogeneously branched polyolefin, preferably a homogeneously branched substantially linear ethylene polymer.

9 Claims, 1 Drawing Sheet

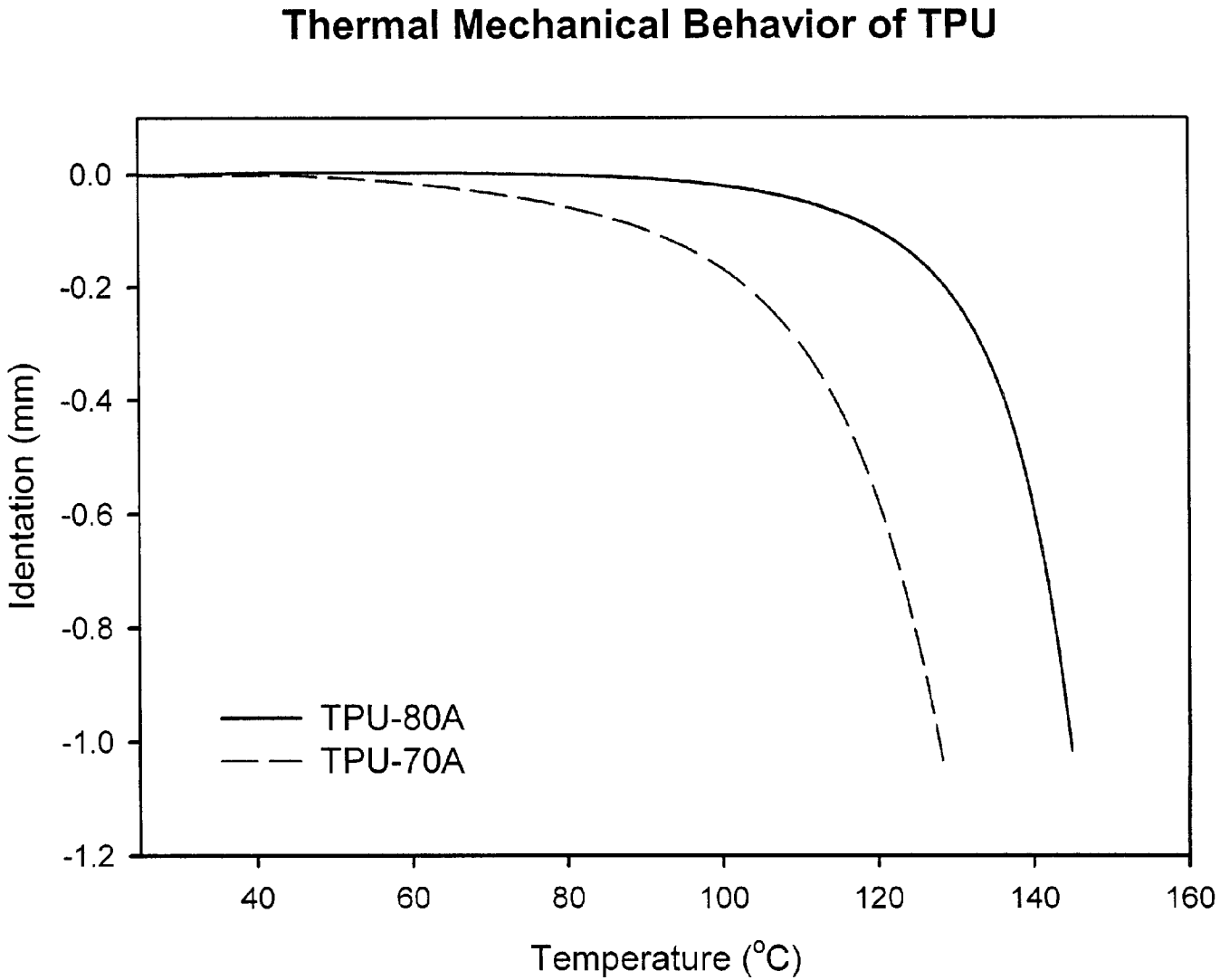
Thermal Mechanical Behavior of TPU
Identation (mm)
0.0
-0.2
-0.4
-0.6
-0.8
-1.0
-1.2
40
60
80
100
120
140
160
Temperature (°C)
TPU-80A
TPU-70A

ELASTIC, HEAT AND MOISTURE RESISTANT BICOMPONENT AND BICONSTITUENT FIBERS

CROSS-REFERENCE TO RELATED APPLICATION

This application claims the benefit of U.S. Provisional Application 60/306,018, filed Jul. 17, 2001.

FIELD OF THE INVENTION

This invention relates to elastic fibers. In one aspect, the invention relates to elastic, heat and moisture resistant fibers while in another aspect, the invention relates to elastic, heat and moisture resistant bicomponent or biconstituent fibers. In another aspect, the invention relates to such bicomponent and biconstituent fibers having a core/sheath construction. In yet another aspect, the invention relates to elastic, heat and moisture resistant bicomponent or biconstituent fibers in which the polymer that forms the sheath is at least partially cross-linked and the polymer that forms the core is heat-settable.

BACKGROUND OF THE INVENTION

Materials with excellent stretchability and elasticity are needed to manufacture a variety of durable articles such as, for example, sport apparel and furniture upholstery. Stretchability and elasticity are performance attributes that function to effectuate a closely conforming fit to the body of the wearer or to the frame of the item. Maintenance of the conforming fit during repeated use, extensions and retractions at body temperatures is very desirable.

A material is typically characterized as elastic where it has a high percent elastic recovery (that is, a low percent permanent set) after application of a biasing force. Ideally, elastic materials are characterized by a combination of three important properties: a low percent permanent set, a low stress or load at strain, and a low percent stress or load relaxation. That is, elastic materials are characterized as having the following properties (1) a low stress or load requirement to stretch the material, (2) no or low relaxing of the stress or unloading once the material is stretched, and (3) complete or high recovery to original dimensions after the stretching, biasing or straining is discontinued.

Spandex is a segmented polyurethane elastic material known to exhibit nearly ideal elastic properties. However, not only is spandex cost prohibitive for many applications, it also exhibits poor resistance to moisture at elevated temperature. This, in turn, compromises the ability to dye fabrics made from it using conventional aqueous dying processes. For example, the thermosol dying process is an aqueous process that employs temperatures in excess of 200 C. Fabrics made from spandex cannot withstand the conditions of this process without a diminution in their elastic properties and as such, fabrics made from spandex must be processed at a lower temperature. This results in higher process costs and less uptake of dye into the fabric.

Elastic materials comprising polyolefins, e.g., polyethylene, polypropylene, polybutylene, etc., are known. These include, among others, U.S. Pat. Nos. 4,425,393, 4,957,790, 5,272,236, 5,278,272, 5,324,576, 5,380,810, 5,472,775, 5,525,257, 5,858,885, 6,140,442 and 6,225,243 all of which are incorporated herein by reference. These disclosures notwithstanding, however, a present need exists for cost-effective elastic articles having good resistance to moisture at elevated temperatures.

SUMMARY OF THE INVENTION

One embodiment of this invention is a fiber having an exterior surface, the fiber comprising at least two elastic polymers, one polymer heat-settable and the other polymer heat-resistant, the heat-resistant polymer comprising at least a portion of the exterior surface.

Another embodiment of this invention is a bicomponent or biconstituent fiber having an exterior surface, the fiber comprising at least two elastic polymers, one polymer heat-settable and the other polymer heat-resistant, the heat-resistant polymer comprising at least a portion of the exterior surface. Preferably, the fiber has a core/sheath construction in which the core comprises the heat-settable polymer and the sheath comprises the heat-resistant polymer.

Another embodiment of this invention is a bicomponent or biconstituent fiber of a core/sheath construction in which the core comprises a thermoplastic urethane (also known as thermoplastic polyurethane) and the sheath comprises a homogeneously branched polyolefin. In a preferred embodiment, the homogeneously branched polyolefin is a homogeneously branched polyethylene, more preferably a homogeneously branched, substantially linear polyethylene.

Another embodiment of this invention is a bicomponent or biconstituent fiber of a core/sheath construction in which the polymer of the sheath has a gel content of greater than about 30 percent. The gel content of the polymer is a measure of the degree to which polymer is cross-linked, and a cross-linked polymer sheath contributes to maintaining the fiber structural integrity under temperatures in excess of the melting temperature of the sheath polymer.

Another embodiment of the invention is a fiber having an exterior surface, the fiber comprising (a) at least two elastic polymers, one polymer a heat-settable elastic polymer, e.g., thermoplastic urethane, and the other polymer a heat-resistant polyolefin, e.g., a polyethylene, the heat-resistant polymer comprising at least a portion of the exterior surface, and (b) a compatibilizer. Preferably, the compatibilizer is a functionalized ethylene polymer, more preferably an ethylene polymer containing at least one anhydride or acid group and even more preferably, an ethylene polymer in which at least some of the anhydride or acid group are reacted with an amine. The use of a compatibilizer promotes the adhesion between the core and sheath polymers of a bicomponent fiber, and the adhesion between the constituents of a biconstituent fiber.

Another embodiment of the invention is a fabricated article manufactured from the bicomponent and/or biconstituent fibers described above.

BRIEF DESCRIPTION OF THE DRAWING

The FIGURE shows a graph of Thermomechanical Analyzer (TMA) probe penetration data which demonstrates that one thermoplastic polyurethane has a higher softening temperature than another thermoplastic polyurethane.

DESCRIPTION OF THE PREFERRED EMBODIMENTS

Elastic Bicomponent and Biconstituent Fibers

As here used, "fiber" or "fibrous" means a particulate material in which the length to diameter ratio of such material is greater than about 10. Conversely, "nonfiber" or "nonfibrous" means a particulate material in which the length to diameter ratio is about 10 or less.

As here used, "elastic" or "elastomeric" describes a fiber or other structure, e.g., a film, that will recover at least about 50 percent of its stretched length after both the first pull and after the fourth pull to 100 percent strain (doubled the length). Elasticity can also be described by the "permanent set" of the fiber. Permanent set is measured by stretching a fiber to a certain point and subsequently releasing it to its original position, and then stretching it again. The percent elongation at which the fiber begins to pull a load is designated as the percent permanent set.

As here used, "heat-settable polymer" means a polymer that when formed into a fiber and (a) elongated 100% under tension, (b) exposed to a heat-setting temperature, and (c) cooled to room temperature, the fiber will exhibit dimensional stability, i.e., resistance to shrinkage, up to a temperature of 110 C.

As here used, "dimensional stability" means that the fiber will not substantially shrink upon exposure to an elevated temperature, e.g., that a fiber will shrink less that 30% of its length when exposed to a temperature of 110 C. for 1 minute.

As here used, "heat-setting temperature" means a temperature at which an elastic fiber experiences a permanent increase in fiber length and a permanent decrease in fiber thickness after the fiber is elongated under tension. The permanent increase or decrease in denier means that the fiber does not return to its original length and thickness, although it may experience a partial recovery of one or both over time. The heat setting temperature is a temperature higher than any likely to be encountered in subsequent processing or use.

As here used, "bicomponent fiber" means a fiber comprising at least two components, i.e., of having at least two distinct polymeric regimes. For simplicity, the structure of a bicomponent fiber is typically referred to as a core/sheath structure. However, the structure of the fiber can have any one of a number of multi-component configurations, e.g., symmetrical core-sheath, asymmetrical core-sheath, side-by-side, pie sections, crescent moon and the like. The essential feature on each of these configurations is that at least part, preferably at least a major part, of the external surface of the fiber comprises the sheath portion of the fiber. FIGS. 1A–1F of U.S. Pat. No. 6,225,243 illustrate various core/sheath constructions.

As here used, "biconstituent fiber" means a fiber comprising an intimate blend of at least two polymer constituents. The construction of a biconstituent fiber is often referred to as "islands-in-the-sea".

The bicomponent fibers used in the practice of this invention are elastic and, each component of the bicomponent fiber is elastic. Elastic bicomponent and biconstituent fibers are known, e.g., U.S. Pat. No. 6,140,442.

In this invention, the core (component A) is a thermoplastic elastomeric polymer illustrative of which are diblock, triblock or multiblock elastomeric copolymers such as olefinic copolymers such as styrene-isoprene-styrene, styrene-butadiene-styrene, styrene-ethylene/butylene-styrene or styrene-ethylene/propylene-styrene, such as those available from the Shell Chemical Company under the trade designation Kraton elastomeric resin; polyurethanes, such as those available from The Dow Chemical Company under the trade designation PELLATHANE polyurethanes or spandex available from E. I. Du Pont de Nemours Co. under the trade designation Lycra; polyamides, such as polyether block amides available from Elf AtoChem Company under the trade designation Pebax polyether block amide; and polyesters, such as those available from E. I. Du Pont de Nemours Co. under the trade designation Hytrel polyester. Thermoplastic urethanes (i.e., polyurethanes) are a preferred core polymer, particularly Pellethane polyurethanes.

The sheath (component B) is also elastomeric, and it comprises a homogeneously branched polyolefin, preferably a homogeneously branched ethylene polymer and more preferably a homogeneously branched, substantially linear ethylene polymer. These materials are well known. For example, U.S. Pat. No. 6,140,442 provides an excellent description of the preferred homogeneously branched, substantially linear ethylene polymers, and it includes many references to other patents and nonpatent literature that describe other homogeneously branched polyolefins.

The homogenously branched polyolefin has a density (as measured by ASTM D 792) of about 0.895 g/cm$^3$ or less. More preferably, the density of the polyolefin is between about 0.85 and about 0.88 g/cm$^3$. The melt index (MI as measured by ASTM D 1238 at 190 C.) for the polyolefin is typically between about 1–50, preferably between about 2–30 and more preferably between about 3–10. For the homogeneously branched ethylene polymers used in the practice of this invention, the crystallinity is typically about 32% for a polymer with a density 0.895 g/cm$^3$, about 21% for a polymer with a density of 0.880 g/cm$^3$, and about 0% for a polymer with a density of 0.855 g/cm$^3$.

The sheath component of the bicomponent or biconstituent fiber is cross-linked to provide it with heat-resistance. This component can be cross-linked using any conventional method, e.g., electromagnetic radiation such as UV (ultraviolet), visible light, IR (infrared), e-beam, silane-moisture curing and combinations of one or more of this cure techniques, and it is typically cross-linked to a gel content to more than 30, preferably more than 50 and more preferably more than 60, weight percent. The gel content is a measure of the degree of cross-linking of the polyolefin. While too much cross-linking, e.g., greater than about 80%, may result in a diminution of the mechanical properties of the fiber, the sheath polymer is cross-linked sufficiently to provide structural integrity to the fiber under moist and hot conditions (e.g., during heat setting and dying operations)

While the fibers of this invention are well suited for woven or knitted applications, e.g., fabrics made by interlacing and interlooping of linear assemblies of filaments and/or fibers, these fibers are also useful in the manufacture of nonwoven structures, e.g., fabrics made by bonding of web-like arrays of fibers and/or filaments. Typically, woven or knitted fabrics prepared with the elastic fibers of this invention comprise between about 1 and about 30, preferably between 3 and about 20, weight percent of the of the fabric. The remaining fibers of the fabric comprise one or more of any other fiber, e.g., a polyolefin (polypropylene, polybutylene, etc.), polyester, nylon, cotton, wool, silk and the like. Woven and knitted fabrics comprising the elastic fibers of this invention exhibit reduced shrinkage when exposed to the processing and maintenance conditions of typical manufacture and use, e.g., aqueous dying, washing and drying, ironing, etc.

Nonwoven fabrics can be formed by techniques known in the art including air-laiding, spun bonding, staple fiber carding, thermal bonding, and melt blown and spun lacing. Polymers useful for making such fibers include polyethylene terephthalate (PET), polybutylene terephthalate (PBT), nylon, polyolefins, silicas, polyurethanes, poly(p-phenylene terephthalamide), Lycra, carbon fibers, and natural polymers such as cellulose and polyamide (e.g., silk and wool). As here used, "fabric" means a manufactured assembly of fibers and/or yarns which has substantial area in relation to its thickness and sufficient mechanical strength to give the assembly inherent cohesion.

As here used, "staple fiber" means a natural fiber or a length cut from, for example, a manufactured filament. One principal use of these fibers is to form absorbent structures that act as a temporary reservoir for liquid and also as a conduit for liquid distribution. Staple fibers include natural and synthetic materials. Natural materials include cellulosic fibers and textile fibers such as cotton and rayon. Synthetic materials include nonabsorbent synthetic polymeric fibers, e.g. polyolefins, polyesters, polyacrylics, polyamides and polystyrenes. Nonabsorbent synthetic staple fibers are preferably crimped, i.e., fibers having a continuous wavy, curvy or jagged character along their length.

The formation of biconstituent fibers is enhanced with the use of a compatibilizer. As here used "compatibilizer" means a polymer that promotes the intimate blending and/or adhesion of the fiber constituent polymers. One preferred compatibilizer is a homogeneously branched ethylene polymer, preferably a homogeneously branched, substantially ethylene polymer grafted with a carbonyl-containing compound, e.g. maleic anhydride, that is reacted with an diamine. Maleic anhydride and other carbonyl-containing compounds grafted to a polyolefin are taught in U.S. Pat. No. 5,185,199. These compatibilizers greatly facilitate the extrusion of the core constituent into the sheath constituent. Compatibilizers useful in the practice of this invention are described in WO 01/36535.

The following examples are illustrative of certain of the embodiments of the invention described above. All parts and percentages are by weight unless otherwise noted.

SPECIFIC EMBODIMENTS

EXAMPLE 1

Bicomponent fibers of a core/sheath construction are prepared from (i) a sheath of Affinity EG8200 (a homogeneously branched, substantially linear ethylene/1-octene copolymer manufactured by The Dow Chemical Company with a density of 0.87 g/cc and an MI of 5), and (ii) a core of either Pellethane 2103-70A or Pellethane 2103-80A (thermoplastic urethanes based on MDI, PTMEG and butanediol, both manufactured by The Dow Chemical Company). The figure shows by Thermomechanical Analyzer (TMA) probe penetration data that TPU-2103-80A has a higher softening temperature than TPU-2103-70A (the probe diameter was 1 mm and force of 1 Newton was applied; the sample was heated at 5 C./min from room temperature). The fibers are prepared using a conventional co-extrusion process such that the fiber sheath is 30 weight percent of the fiber, and the fiber core is 70 weight percent of the fiber. The fibers are crosslinked using e-beam at 19.2 megarad under nitrogen.

After crosslinking, the fibers are heat-set. The fibers are first drafted (i.e. elongated) under ambient conditions and taped to a Teflon substrate while under load. The fibers are then place in an oven at a pre-set temperature for a predetermined time (while still under load), removed and allowed to cool to room temperature, released from the load and then measured. The amount of shrinkage from the elongated state is a measure of the heat set efficiency. Fibers that do not shrink after the release of the load are 100% heat set efficient. Fibers that return to their pre-load elongated length after the release of the load are 0% heat set efficient.

After the fiber is heat set, it is then placed within an oil bath held at a pre-set temperature for thirty seconds, removed, and measured again. The length of the fiber after treatment in the oil bath over the length of the fiber before treatment in the oil bath is a measure of the shrinkage of the heat set fiber.

TABLE 1

Effect of Heat Setting Temperature EG8200/TPU-80A (30/70)

| | Draft | Heat set Efficiency (%) | Shrink (Oil Bath) temperature (° C.) | Shrinkage (%) |
|---|---|---|---|---|
| T = 200° C. | 1.5 | 100 | 90 | 3.8 |
| t = 2 min | 1.5 | 100 | 110 | 10.5 |
| | 1.5 | 100 | 130 | 33.5 |
| | 1.5 | 100 | 150 | 45.2 |
| T = 230° C. | 1.5 | 100 | 90 | 5.8 |
| t = 2 min | 1.5 | 100 | 110 | 13.0 |
| | 1.5 | 100 | 130 | 40.2 |
| | 1.5 | 100 | 150 | 45.1 |

As demonstrated by the data of Table 1, the heat set efficiency and the shrinkage at a given temperature is not materially impacted by the heat set temperature. The shrink temperature, however, has a material impact on the percent shrinkage with the greater shrinkage associated with the higher shrink temperature.

TABLE 2

Effect of Heat Setting Time EG8200/TPU-80A (30/70)

| | Draft | Heat set Efficiency (%) | Shrink (Oil Bath) Temperature (° C.) | Shrinkage (%) |
|---|---|---|---|---|
| T = 200° C. | 1.5 | 100 | 90 | 3.8 |
| t = 2 min | 1.5 | 100 | 110 | 10.5 |
| | 1.5 | 100 | 130 | 33.5 |
| | 1.5 | 100 | 150 | 45.2 |
| T = 200° C. | 1.5 | 100 | 90 | 3.8 |
| t = 4 min | 1.5 | 100 | 110 | 14.0 |
| | 1.5 | 100 | 130 | 40.5 |
| | 1.5 | 100 | 150 | 44.4 |
| T = 200° C. | 1.5 | 100 | 90 | 2.6 |
| t = 10 min | 1.5 | 100 | 110 | 10.3 |
| | 1.5 | 100 | 130 | 37.9 |
| | 1.5 | 100 | 150 | 41.0 |

The data of Table 2 demonstrates that the heat set efficiency and the shrinkage at a given temperature is not materially impacted by the heat set time.

TABLE 3

Effect of Composition

| | Draft | Heat set efficiency (%) | Shrink (Oil Bath) Temperature (° C.) | Shrinkage (%) |
|---|---|---|---|---|
| EG8200/ | 1.5 | 97.3 | 110 | 28.7 |
| TPU-70A | 1.5 | 95.3 | 130 | 37.5 |

TABLE 3-continued

| Effect of Composition | | | | |
|---|---|---|---|---|
| | Draft | Heat set efficiency (%) | Shrink (Oil Bath) Temperature (° C.) | Shrinkage (%) |
| (30/70) | 1.5 | 98.3 | 150 | 44.9 |
| | 2.0 | 93.8 | 90 | 25.4 |
| | 2.0 | 94.8 | 110 | 34.7 |
| | 2.0 | 94.4 | 130 | 48.6 |
| | 2.0 | 90.7 | 150 | 54.2 |
| EG8200* | 2.0 | 93.8 | 90 | 57.4 |
| | 2.0 | 94.6 | 150 | 71.0 |

*Affinity fiber of 40 denier and crosslinked using e-beam at 22.4 megarad under nitrogen.

The data of Table 3 demonstrates that a fiber with an Affinity sheath and TPU core shrinks less than an Affinity fiber.

TABLE 4

| Effect of Composition (0.75 mm die) | | | | |
|---|---|---|---|---|
| | Draft | Heat set efficiency (%) | Shrink (Oil Bath) Temperature ° C. | Shrinkage (%) |
| EG8200/ TPU-80A (30/70) | 1.5 | 100 | 110 | 15.4 |
| | 1.5 | 100 | 130 | 24.2 |
| | 1.5 | 100 | 150 | 38.4 |
| | 2.0 | 100 | 90 | 6.6 |
| | 2.0 | 100 | 110 | 18.7 |
| | 2.0 | 100 | 130 | 38.7 |
| | 2.0 | 100 | 150 | 49.7 |
| EG8200* | 2.0 | 93.8 | 90 | 57.4 |
| | 2.0 | 94.6 | 150 | 71.0 |

*Affinity fiber of 40 denier and crosslinked using e-beam at 22.4 megarad under nitrogen.

The data of Table 4 demonstrates that a fiber with an Affinity sheath and with a different TPU core also shrinks less than an Affinity fiber.

TABLE 5

| Effect of TPU | | | | |
|---|---|---|---|---|
| Composition | Draft | Heat set efficiency (%) | Shrink (Oil Bath) Temperature ° C. | Shrinkage (%) |
| EG8200/ TPU-70A (30/70) | 1.5 | 100.0 | 90 | 15.5 |
| | 1.5 | 97.3 | 110 | 28.7 |
| | 1.5 | 95.3 | 130 | 37.5 |
| | 1.5 | 98.3 | 150 | 44.9 |
| | 2.0 | 93.8 | 90 | 25.4 |
| | 2.0 | 94.8 | 110 | 34.7 |
| | 2.0 | 94.4 | 130 | 48.6 |
| | 2.0 | 90.7 | 150 | 54.2 |
| EG8200/ TPU-80A (30/70) | 1.5 | 100 | 90 | 2.3 |
| | 1.5 | 100 | 110 | 15.4 |
| | 1.5 | 100 | 130 | 24.2 |
| | 1.5 | 100 | 150 | 38.4 |
| | 2.0 | 100 | 90 | 6.6 |
| | 2.0 | 100 | 110 | 18.7 |

TABLE 5-continued

| Effect of TPU | | | | |
|---|---|---|---|---|
| Composition | Draft | Heat set efficiency (%) | Shrink (Oil Bath) Temperature ° C. | Shrinkage (%) |
| | 2.0 | 100 | 130 | 38.7 |
| | 2.0 | 100 | 150 | 49.7 |

The data of Table 5 demonstrates that TPU-80A has lower shrinkage than TPU-70A, and TPU-70A has a lower softening point than TPU-80A. Typically, cores that have a higher softening point are desirable because they experience less shrinkage and this property is imparted to the fabrics from which they are made.

TABLE 6

| Effect of Composition | | | | |
|---|---|---|---|---|
| Composition | Draft | Heat set Efficiency (%) | Shrink (Oil Bath) temperature (° C.) | Shrinkage (%) |
| TPU-80A (30%) + Affinity (70%) | 1.5 | 97 | 90 | 29.4 |
| | 1.5 | 99 | 110 | 40.9 |
| | 1.5 | 98 | 130 | 53.5 |
| | 1.5 | 100 | 150 | 57.7 |
| | 2.0 | 95 | 90 | 37.8 |
| | 2.0 | 95 | 110 | 57.5 |
| | 2.0 | 95 | 130 | 66.5 |
| | 2.0 | 91 | 150 | 67.6 |
| TPU-80A (50%) + Affinity (50%) | 1.5 | 100 | 90 | 15.9 |
| | 1.5 | 100 | 110 | 27.1 |
| | 1.5 | 97 | 130 | 47.2 |
| | 1.5 | 100 | 150 | 49.0 |
| | 2.0 | 96 | 90 | 18.8 |
| | 2.0 | 98 | 110 | 34.1 |
| | 2.0 | 94 | 130 | 58.1 |
| | 2.0 | 97 | 150 | 56.6 |
| TPU-80A (70%) + Affinity (30%) | 1.5 | 100 | 90 | 7.9 |
| | 1.5 | 100 | 110 | 17.8 |
| | 1.5 | 100 | 130 | 41.7 |
| | 1.5 | 100 | 150 | 44.8 |
| | 2.0 | 100 | 90 | 15.0 |
| | 2.0 | 100 | 110 | 19.4 |
| | 2.0 | 100 | 130 | 51.0 |
| | 2.0 | 99 | 150 | 59.8 |

The data of Table 6 demonstrates that the higher the weight percent of the TPU in the core, the lower the shrinkage.

EXAMPLE 2

Biconstituent fibers are prepared from the blend of (i) a sheath of Affinity EG8200 (a homogeneously branched, substantially linear ethylene/1-octene copolymer manufactured by The Dow Chemical Company), (ii) a core of either Pellethane 2103-70A or Pellethane 2103-80A, and (iii) MAH-g-Affinity ethylene copolymer reacted with a diamine. The blends are first prepared using a twin-screw extruder, and then the fibers are prepared using a conventional spinning process. The fibers are crosslinked using e-beam at 19.2 megarad under nitrogen.

TABLE 7

| Status of Fiber Spinning from Blends | | |
|---|---|---|
| Blends without compatibilizer | Not extrudable | N/A |
| Blends with compatibilizer | Spun | T-210–230 C. (Spinning Temperature) |

TABLE 8

Effect of TPU on Heat Shrinkage (30% TPU + 70% Affinity + 10% Fusabond)

| TPU | Draft | Heat set Efficiency (%) | Shrink (Oil Bath) temperature (° C.) | Shrinkage (%) |
|---|---|---|---|---|
| TPU-70A | 1.5 | 97 | 90 | 36.3 |
| | 1.5 | 94 | 110 | 42.2 |
| | 1.5 | 97 | 130 | 47.3 |
| | 1.5 | 96 | 150 | 48.3 |
| | 2.0 | 90 | 90 | 47.5 |
| | 2.0 | 94 | 110 | 51.8 |
| | 2.0 | 89 | 130 | 58.6 |
| | 2.0 | 92 | 150 | 59.6 |
| TPU-80A | 1.5 | 97 | 90 | 27.4 |
| | 1.5 | 95 | 110 | 38.0 |
| | 1.5 | 98 | 130 | 41.7 |
| | 1.5 | 97 | 150 | 50.1 |
| | 2.0 | 92 | 90 | 36.0 |
| | 2.0 | 94 | 110 | 43.8 |
| | 2.0 | 92 | 130 | 57.0 |
| | 2.0 | 93 | 150 | 58.6 |
| EG8200* | 2.0 | 93.8 | 90 | 57.4 |
| | 2.0 | 94.6 | 150 | 71.0 |

*Affinity fiber of 40 denier and crosslinked using e-beam at 22.4 megarad under nitrogen.

The data of Table 8 demonstrates that the higher the softening temperature of the TPU core, the smaller the shrinkage of the fiber.

TABLE 9

Comparison of Elastic Recovery of Bicomponent with Biconstituent fiber

| Applied Strain (%) | Instantaneous Set (%) Biconstituent | Bicomponent | EG8200* |
|---|---|---|---|
| 50 | 6 | 6 | 6 |
| 75 | 8 | 11 | 9 |
| 100 | 13 | 14 | 13 |
| 150 | 27 | 35 | 29 |
| 200 | 50 | 69 | 56 |

*Affinity fiber of 40 denier and crosslinked using e-beam at 22.4 megarad under nitrogen.

The data of Table 9 demonstrates that the biconstituent and bicomponent fibers exhibited a similar elasticity recovery as did the Affinity fiber.

Although the invention has been described in detail by the preceding examples, the detail is for the purpose of illustration and is not to be construed as a limitation upon the invention. Many variations can be made upon the preceding examples without departing from the spirit and scope of the following claims.

What is claimed is:

1. A fiber having an exterior surface, the fiber comprising at least two elastic polymers, one polymer heat-settable and the other polymer a heat-resistant polyethylene, the heat-resistant polyethylene comprising at least a portion of exterior surface and having a gel-content of more than about 30 wt %, the fiber further comprising a compatibilizer.

2. The fiber of claim 1 in which the compatibilizer is a functionalized ethylene polymer.

3. The fiber of claim 2 in which the compatibilizer is an ethylene polymer containing at least one anhydride or acid group.

4. The fiber of claim 3 in which the compatibilizer has been reacted with an amine.

5. The fiber of claim 1 in which the polyolefin is a homogenously branched, substantially linear ethylene polymer.

6. A woven or knitted fabric comprising the fiber of claim 1.

7. A nonwoven fabric comprising the fiber of claim 1.

8. A woven or knitted fabric of claim 6 comprising between 1 and 30 wt % based on the weight of the fabric.

9. The woven or knitted fabric of claim 1 comprising between 1 and 30 wt % of the fabric, the fabric exhibiting reduced shrinkage when exposed to moisture at an elevated temperature, as compared to a fabric alike in all respects except for containing fibers of claim 1.

* * * * *